US008202472B2

(12) United States Patent
Noda et al.

(10) Patent No.: US 8,202,472 B2
(45) **Date of Patent: *Jun. 19, 2012**

(54) METHOD FOR CONTROLLING A PROCESS FOR AUTOMATICALLY POURING MOLTEN METAL, A SYSTEM FOR CONTROLLING A SERVOMOTOR OF AN AUTOMATIC POURING APPARATUS, AND A MEDIUM FOR RECORDING PROGRAMS FOR CONTROLLING A TILTING OF A LADLE

(75) Inventors: Yoshiyuki Noda, Toyohashi (JP); Kazuhiko Terashima, Toyohashi (JP); Takanori Miyoshi, Toyohashi (JP); Kazuhiro Ota, Shinshiro (JP); Makio Suzuki, Shinshiro (JP)

(73) Assignees: Sintokogio, Ltd., Aichi (JP); National University Corporation Toyohashi University of Technology, Aichi (JP)

( * ) Notice: Subject to any disclaimer, the term of this patent is extended or adjusted under 35 U.S.C. 154(b) by 0 days.

This patent is subject to a terminal disclaimer.

(21) Appl. No.: 12/597,143

(22) PCT Filed: Mar. 28, 2008

(86) PCT No.: PCT/JP2008/056060

§ 371 (c)(1),
(2), (4) Date: Oct. 22, 2009

(87) PCT Pub. No.: WO2008/136227

PCT Pub. Date: Nov. 13, 2008

(65) Prior Publication Data

US 2010/0116855 A1 May 13, 2010

(30) Foreign Application Priority Data

Apr. 27, 2007 (JP) ..... 2007-118393
Sep. 17, 2007 (JP) ..... 2007-240321

(51) Int. Cl.
*B22D 41/06* (2006.01)

(52) U.S. Cl. ..... 266/45; 266/96; 266/99

(58) Field of Classification Search ..... 266/78, 266/96, 99, 275, 45
See application file for complete search history.

(56) References Cited

U.S. PATENT DOCUMENTS 6,280,499 B1 * 8/2001 Koffron ..... 75/375
(Continued)

FOREIGN PATENT DOCUMENTS

JP 6-7919 1/1994
JP 2004-80838 A 3/2004
(Continued)

OTHER PUBLICATIONS

Machine translation of JP 2005-088041 (Apr. 7, 2005).*

*Primary Examiner* — Scott Kastler
(74) *Attorney, Agent, or Firm* — Finnegan, Henderson, Farabow, Garrett & Dunner, L.L.P.

(57) ABSTRACT

A method for controlling a ladle to pour molten metal into a mold. The method comprises producing a mathematical model describing a relationship between a measured electrical voltage supplied to a servomotor for tilting the ladle and a flow rate of the molten metal flowing out of the ladle when the ladle is tilted; solving an inverse problem of the mathematical model; estimating the flow rate of the molten metal using a state observer having an exponential damping that uses an extended Kalman filter, based on the measured electrical voltage and a weight of the molten metal poured into the mold; processing the flow rate of the molten metal and a target flow rate of the molten metal with a gain-scheduled PI controller; obtaining a target electrical voltage to be supplied to the servomotor; and controlling the servomotor based on the target electrical voltage.

8 Claims, 14 Drawing Sheets

U.S. PATENT DOCUMENTS

| | | | | |
|---|---|---|---|---|
| 2010/0010661 | A1* | 1/2010 | Terashima et al. | 700/146 |
| 2010/0059555 | A1* | 3/2010 | Noda et al. | 222/604 |
| 2010/0133302 | A1* | 6/2010 | Noda et al. | 222/590 |

FOREIGN PATENT DOCUMENTS

| | | | |
|---|---|---|---|
| JP | 2005-88041 | A | 4/2005 |

* cited by examiner

A Control System Having Two Degrees of Freedom for Controlling Rate of Flow of a Molten Metal Fig. 8 Results of Experiments Fig. 9 Method for Compensating for an Error of Measurements of a Load Cell Fig. 10 Weight of the Measured Molten Metal Poured into the Mold by Using a Method for Compensating for an Error of Measurements of a Load Cell Result of a Simulation of Pouring a Molten Metal, Taking Account of Noise in the System (a)Simulation (b)Experiment Comparison of the Result of the Estimated Rate of the Flow of the Molten Metal Gain of the Observer Results of the Experiments for Estimating the Rate of the Flow of the Molten Metal When the Initial Mismatch of the Tilted Angles of the Ladle is Caused

METHOD FOR CONTROLLING A PROCESS FOR AUTOMATICALLY POURING MOLTEN METAL, A SYSTEM FOR CONTROLLING A SERVOMOTOR OF AN AUTOMATIC POURING APPARATUS, AND A MEDIUM FOR RECORDING PROGRAMS FOR CONTROLLING A TILTING OF A LADLE

TECHNICAL FIELD

The present invention is directed to a method for controlling a process for automatically pouring molten metal by a ladle, to a system for controlling a servomotor of an automatic pouring apparatus, and to a medium for recording programs for controlling the tilting of a ladle. More specifically, it is directed to a method for controlling a servomotor, a system for controlling a servomotor of an automatic pouring apparatus, and to a medium that record programs for controlling the tilting of a ladle, so as to result in a molten metal being poured into a mold with a desired flow pattern, wherein the ladle is tilted by means of the servomotor, which is controlled by a computer that is programmed to pour the molten metal.

BACKGROUND OF THE INVENTION

Recently mechanizations and automation have been introduced in the process of pouring in foundries to relieve operators of extremely dangerous and severe work encountered in that process. Conventionally a system is adopted that comprises a ladle, a means to drive the ladle, a means to detect the weight of the ladle, and a recording and processing device that records in advance the ratio of the weight change in the ladle when the ladle is tilted, adjusts the speed of the tilting of the ladle corresponding to the signal received from the means to detect the weight, and after adjustment sends to the means to drive the ladle a signal on the speed of tilting the ladle (see Patent document 1).

Patent Document 1: Publication of Laid-Open Patent Application No. H6-7919

DISCLOSURE OF INVENTION

However, the conventional automatic pouring system thus constituted has a problem, for example, in that the data input in the recording and processing device, of the information on, for example, the means to drive the ladle, is done practically by a teaching-and-playback method. Hence the system cannot cope with an inappropriate speed of titling the ladle or changes in the conditions of the pouring. As a result, for example, the castings become inferior in quality, because a sufficient quantity of molten metal is not poured into the mold, or impurities like dust, slag, etc., are disposed in the mold.

The present invention aims to solve the above-mentioned problems. The present invention provides a method for controlling a process for automatically pouring molten metal by a ladle, which is tilted to pour the molten metal, a system for controlling a servomotor of an automatic pouring apparatus, and a medium that record programs for controlling the tilting of the ladle, wherein the pouring process can be performed in a manner that is as close as possible to that of an experienced operator by using a computer that has programs installed for such purpose.

To achieve the object stated above, the method for controlling a process for automatically pouring the molten metal of the present invention is one that controls a servomotor, corresponding to the desired flow pattern of the molten metal, so that the molten metal can be poured into a mold, wherein the servomotor, which tilts the ladle to pour the molten metal in a mold, is controlled by a computer that has programs previously installed that control the process of pouring. The method is characterized in that it comprises:

producing a mathematical model covering the electrical voltage that is supplied to the servomotor to the rate of the flow of the molten metal poured by the ladle, solving the inverse problem of the mathematical model thus produced, estimating the rate of the flow of the molten metal by an observer having an exponential damping that uses an extended Kalman filter, based on an electrical voltage being supplied to the servomotor and the weight of the molten metal poured into the mold that is measured by weighing equipment, wherein the measurement is calibrated by eliminating errors caused by the movement of the center of gravity of the object to be measured, treating the rate of the flow of the molten metal and the targeted rate of the flow of the molten metal with a gain-scheduled PI controller (proportional-integral controller), obtaining data on the electrical voltage to be supplied to the servomotor thereby, and controlling the servomotor based on the data of the electrical voltage thus obtained and to be supplied to the servomotor.

The method of the mathematical model that is used for the purpose of the present invention is one which includes obtaining, by solving expressions relating to the thermal balance of a process, the balance of substances, chemical reactions, restricting conditions, etc., functions, such as profits, costs, etc., which are the objects to be controlled by the computer, and obtaining the maximum and minimum values of the functions and then controlling the process to attain them. For the present invention, the ladle is supported at a position near its center of gravity.

As is clear from the foregoing explanations, the method of the present invention has an advantageous effect such as that automatic pouring by the ladle can be carried out by the programs that are installed in a computer. Hence the pouring can be carried out in a manner that is as close as possible to that of an experienced operator. Further, since the servomotor is controlled by the feedback-control system based on the estimated rate of the flow of the molten metal, when the targeted rate of the flow of the molten metal varies, or when the pouring process is carried out in an environment having existing disturbances, the desired rate of the flow of the molten metal is achieved with high accuracy.

The basic Japanese Patent Applications, No. 2007-118393, filed Apr. 27, 2007, and No. 2007-240321, filed Sep. 17, 2007, are hereby incorporated in their entirety by reference in the present application.

The present invention will become more fully understood from the detailed description given below. However, the detailed description and the specific embodiment are illustrations of desired embodiments of the present invention, and are described only for an explanation. Various possible changes and modifications will be apparent to those of ordinary skill in the art on the basis of the detailed description.

The applicant has no intention to dedicate to the public any disclosed embodiment. Among the disclosed changes and modifications, those which may not literally fall within the scope of the present claims constitute, therefore, a part of the present invention in the sense of the doctrine of equivalents.

The use of the articles "a," "an," and "the" and similar referents in the specification and claims are to be construed to cover both the singular and the plural, unless otherwise indicated herein or clearly contradicted by the context. The use of any and all examples, or exemplary language (e.g., "such as") provided herein, is intended merely to better illuminate the invention, and so does not limit the scope of the invention, unless otherwise claimed.

PREFERRED EMBODIMENTS OF THE INVENTION

Below, based on FIGS. 1-14 an embodiment of the automatic pouring apparatus to which the present invention is applied is explained in detail by the Examples. As shown in FIG. 1, the automatic pouring apparatus of the present invention comprises a ladle 1 with a cylindrical shape, a servomotor 2 that tilts this ladle 1, a transfer means 5 that transfers the ladle 1 and the servomotor 2 vertically and horizontally by means of two sets of ball screw mechanisms 3, 4 that convert a rotational movement of an output shaft of the servomotor to a linear movement, a load cell (not shown) that detects the weight of the molten metal in the ladle 1, and a control system 6 that calculates the movements of the servomotor 2 and of two sets of ball screw mechanisms 3, 4 and that also controls them by using a computer.

The output shaft of the servomotor 2 is connected at the center of gravity of the ladle 1. The ladle is supported at its center of gravity and can be tilted forward and backward around it in the direction toward and away from the sprue of the mold. Because the ladle 1 can tilt around its center of gravity, the weight of the load on the servomotor 2 can be reduced.

To have the molten metal be precisely poured in the sprue of the mold, the transfer mechanism 5 operates in a manner by which it moves the ladle backward and forward and upward and downward in coordination with the tilting of the ladle, such that the end of the outflow position can act as a fixed center point for a virtual axis for turning.

The automatic pouring apparatus thus constituted controls the tilting of the ladle 1 by means of a control system 6, corresponding to the electric voltage supplied to the servomotor 2. The electric voltage is obtained by solving the inverse problem of a mathematical model that is produced by estimating the rate of the flow of the molten metal by an observer having an exponential damping that uses an extended Kalman filter, wherein the rate is estimated based on the weight of the molten metal poured into the mold that is measured by a load cell that acts as weighing equipment, and then by treating the estimated rate of the flow of the molten metal with a gain-scheduled PI controller (proportional-integral controller). The model shows the relationship between the tilting of the ladle 1 that is caused by the electrical voltage supplied to the servomotor 2 and the rate of the flow of the molten metal to be poured from the ladle 1 by the tilting of the ladle 1.

That is, in FIG. 2, which shows a vertical cross-sectional view of the ladle 1 when it is pouring, given that θ [degree] is the angle of the tilting of the ladle 1, Vs (θ) [$m^3$] is the volume of the molten metal (a darkly shaded region) below the line which runs horizontally through the outflow position, which is the center of tilting of the ladle 1, A (θ) [$m^2$] is the horizontal area on the outflow position (the area bordering the horizontal area between the darkly shaded region and the lightly shaded region), Vr [$m^3$] is the volume of the molten metal above the outflow position (the lightly shaded region), h [m] is the height of the molten metal above the outflow position, and q [$m^3$/s] is the rate of the flow of the molten metal that flows from the ladle 1, then the expression that shows the balance of the molten metal in the ladle 1 from the time t [s] to the Δt [s] after t [s] is given by the following expression (1):

$$Vr(t)+Vs(\theta(t))=Vr(t+\Delta t)+Vs(\theta(t+\Delta t))+q(t)\Delta t \tag{1}$$

If the terms that have Vr [$m^3$] in expression (1) are brought together and Δt is caused to be 0, the following expression (2) is obtained:

$$\begin{aligned}\lim_{\Delta t\to 0} &= \frac{V_r(t+\Delta t)-V_r(t)}{\Delta t}\\ &= \frac{dV_r(t)}{dt}\\ &= -q(t)-\frac{dV_s(\theta(t))}{dt}\\ &= -q(t)-\frac{\partial V_s(\theta(t))}{\partial\theta(t)}\frac{d\theta(t)}{dt}\end{aligned} \tag{2}$$

Also, the angular velocity of the tilting of the ladle 1, ω[degree/s], is defined by the following expression (3):

$$\omega(t)=d\theta(t)/dt \tag{3}$$

If expression (3) is substituted for the value in expression (2), then expression (4) is obtained.

$$\frac{dV_r(t)}{dt}=-q(t)-\frac{\partial V_s(\theta(t))}{\partial\theta(t)}\omega(t) \tag{4}$$

The volume of the molten metal above the outflow position Vr [$m^3$] is given by the following expression (5):

$$V_r(t)=\int_0^{h(t)}A_s(\theta(t),h_s)\,dh_s \tag{5}$$

Area As [$m^2$] shows the horizontal area of the molten metal at height $h_s$ [m] above the horizontal area on the outflow position.

If area As [$m^2$] is broken down into the horizontal area of the outflow position A [$m^2$] and the amount of the change of area ΔAs [$m^2$] over the area A [$m^2$], then the volume Vr [$m^3$] is given by the following expression (6):

$$\begin{aligned}V_r(t)&=\int_0^{h(t)}(A(\theta(t))+\Delta A_s(\theta(t),h_s))dh_s\\ &=A(\theta(t))h(t)+\int_0^{h(t)}\Delta A_s(\theta(t),h_s)\,dh_s\end{aligned} \tag{6}$$

With ladles in general, including the ladle 1, because the amount of the change of area ΔAs [$m^2$] is very small compared to the horizontal area on the outflow position A [$m^2$], the following expression (7) is obtained:

$$A(\theta(t))h(t)\gg\int_0^{h(t)}\Delta A_s(\theta(t),h_s)\,dh_s \tag{7}$$

Thus expression (6) can be shown as the following expression (8):

$$V_r(t)\approx A(\theta(t))h(t) \tag{8}$$

Then the following expression (9) is obtained from expression (8):

$$h(t) \approx V_r(t)/A(\theta(t)) \tag{9}$$

The rate of the flow of the molten metal q [$m^3$/s] that flows from the ladle 1 at height h [m] above the outflow position is obtained from Bernouilli's theorem. It is given by the following expression (10):

$$q(t) = c\int_0^{h(t)} \left(L_f(h_b)\sqrt{2gh_b}\right)dh_b,\ (0 < c < 1) \tag{10}$$

wherein $h_b$ [m] is, as shown in FIG. 4, the depth of the molten metal from its surface in the ladle 1, $L_f$[m] is the width of the outflow position at depth $h_b$ [m] of the molten metal, c is a coefficient of the flow of the molten metal that flows out, and g is the gravitational acceleration.

Further, the following expressions (11) and (12), which show the basic model of the expression for the flow of the molten metal, are obtained from the expressions (4), (9) and (10):

$$\frac{dV_r(t)}{dt} = -c\int_0^{\frac{V_r(t)}{A(\theta(t))}} \left(L_f(h_b)\sqrt{2gh_b}\right)dh_b - \frac{\partial V_s(\theta(t))}{\partial\theta}\omega(t) \tag{11}$$

$$q(t) = c\int_0^{\frac{V_r(t)}{A(\theta(t))}} \left(L_f(h_b)\sqrt{2gh_b}\right)dh_b,\ (0 < c < 1) \tag{12}$$

The horizontal area on the outflow position, A (θ) [$m^2$], changes depending on the angle of the tilting of the ladle 1, θ[degrees]. Thus the model expressions (14) and (15) for the rate of the flow of the molten metal will be non-linear models. Their parameters are variable depending on how the system matrix, input matrix, and output matrix vary based on the angle of the tilting of the ladle 1.

FIG. 5 is a block diagram that shows the process for pouring the molten metal by the automatic pouring apparatus of the first embodiment of the present invention. In FIG. 5, a model for the revolutions of the motor is shown by the following expression (16) of the first order lag:

$$d\omega(t)/dt = -\omega(t)/T_m + K_m u/T_m \tag{16}$$

wherein $T_m$[s] denotes a time constant and $K_m$ [degree/s V] denotes a gain constant. In the present automatic pouring apparatus, $T_m$=0.006 [s], and $K_m$=24.58 [degree/s V].

If the dynamic characteristics of the load cell are considered, then $P_L$ of the load cell is shown by the following expression (17).

$$dw_L/dt = w_L(t)/T_L + w(t)/T_L \tag{17}$$

wherein w [Kg] is the weight of the liquid that has flowed from the ladle 1, $w_L$ [Kg] is the weight to be measured by the load cell, and $T_L$ [s] is a time constant that shows the lag of the response of the load cell. In the present automatic pouring apparatus, where the time constant was measured by a step response method, $T_L$ was identified as $T_L$=0.10 [s].

Regarding model expressions (11) and (12) for the rate of the flow of the molten metal, FIG. 6 shows the horizontal area on the outflow position, A(θ) [$m^2$], at the angle of the tilting of the ladle 1, θ [degrees], and the volume of the molten metal (liquid), Vs (θ) [$m^3$], below the line which runs horizontally through the outflow position. In FIG. 6, (a) shows the horizontal area of the outflow position, A (θ) [$m^2$], when the angle of the tilting of the ladle 1 is θ[degrees], (b) shows the volume of the molten metal (liquid), Vs (θ) [$m^3$], below the line which runs horizontally through the outflow position, when the angle of the tilting of the ladle 1 is θ [degrees].

Next, by using the model expression for the rate of the flow of the molten metal, a feed-forward control for the rate of the flow of the molten metal is constructed, based on its inverse model. The feed-forward control is a method for control wherein the output is controlled so that it becomes a target value, by adjusting to the predetermined values those values that will be added to the objects to be controlled. By this method a favorable control can be achieved if the relationships of the input to the output in the objects to be controlled or the effects of an exterior disturbance are obvious.

FIG. 7 is a block diagram for a control system in a system wherein, so as to achieve the desired flow pattern of the molten metal, $q_{ref}$[$m^3$/s], the input voltage for control of u [V] that is supplied to the servomotor 2, is obtained. The inverse model $P_m^{-1}$ of the servomotor 2 is shown by the following expression (18):

$$u(t) = \frac{T_m}{K_m}\frac{d\omega_{ref}(t)}{dt} + \frac{1}{K_m}\omega_{ref}(t) \tag{18}$$

An inverse model for the basic expression of the model of the rate of the flow of the molten metal as shown by expressions (11) and (12) will be obtained. The rate of the flow of the molten metal, q [$m^3$/s], which is the volume of the molten metal that flows at a height h [m] above the outflow position, can be obtained from the expression (10), which is Bernouilli's theorem. The maximum height, $h_{max}$[m], is divided equally by n. Each divided height is denoted by Δh [m], wherein $h_{max}$ [m] is the height above the outflow position when from the shape of the ladle 1 the volume above the outflow position is considered as being the largest. Each height of the molten metal $h_i$ is shown as $h_i$=iΔh(i=0, . . . n). Thus the rate of the flow of the molten metal that flows, $q=[q_0, q_1 \ldots q_n]^T$, for the height, $h=[h_0, h_1 \ldots h_n]^T$, is shown by the following expression (19):

$$q = f(h) \tag{19}$$

wherein function f (h) is Bernouilli's theorem as shown by the expression (10). Thus the inverse function of expression (19) is given by the following expression (20):

$$h = f^{-1}(q) \tag{20}$$

This expression (20) can be obtained by inverting the relationship of the input and output factors in expression (19). (h) in expression (20) is obtained from the "Lookup Table." Now, if $q_i \rightarrow q_{i+1}$, and $h_i \rightarrow h_{i+1}$, then the relationship can be expressed by a linear interpolation. If the width that is obtained after the height, $h_{max}$[m], is divided, is narrower, the more precisely can be expressed the relationship of the rate of the flow of the molten metal, q [$m^3$/s], to the height h [m] above the outflow position. Thus it is desirable to make the width of the division as narrow as practically possible.

The height of molten metal above the outflow position, $h_{ref}$ [m], which is to achieve the desired flow pattern of the molten metal, $q_{ref}$[$m^3$/s], is obtained from the expression (20) and is shown by the following expression (21):

$$h_{ref}(t) = f^{-1}(q_{ref}(t)) \tag{21}$$

Also, given that the height of the molten metal above the outflow position is $h_{ref}$ [m], the volume of the molten metal above the outflow position, Vref [$m^3$], is shown by the expression (22), which is obtained from the expression (9).

$$V_{ref}(t)=A(\theta(t))h_{ref}(t) \tag{22}$$

Next, if the volume of the molten metal above the outflow position, $V_{ref}$[$m^3$], as shown by the expression (22), and the desired flow pattern of the molten metal, $q_{ref}$[$m^3$/s], are substituted for the values in the basic model expression (11) for the rate of the flow of the molten metal, then the following expression (23) is obtained. It shows the angular velocity of the tilting of the ladle 1, $\omega_{ref}$[degree/s]. This angular velocity is to achieve the desired flow pattern of the molten metal.

$$\omega_{ref}(t) = -\frac{\frac{dV_{rref}(t)}{dt} + q_{ref}(t)}{\frac{\partial V_s(\theta(t))}{\partial \theta(t)}} \tag{23}$$

By solving in turn expressions (19) to (23) and substituting the angular velocity of the tilting of the ladle 1, $\omega_{ref}$[degree/s], which is obtained, for the values in the expression (18), so as to produce the desired flow pattern of the molten metal, $q_{ref}$ [$m^3$/s], the input voltage for control, u [V], which is to be supplied to the servomotor 2, can be obtained.

Substitute both the volume of the molten metal above the outflow position, $V_{ref}$[$m^3$], which was obtained from expression (22), and the desired flow pattern of the molten metal, $q_{ref}$ [$m^3$/s], for the values in the expression (23). Then the angular velocity of the tilting of the ladle 1, $\omega_{ref}$[degree/s], which is to achieve the desired flow pattern of the molten metal, is obtained. Next, substitute the angular velocity of the tilting of the ladle 1, $\omega_{ref}$[degree/s], that was obtained, for the value of the inverse model of the expression (18) for the servomotor 2. Then the input voltage for control, u (V), that is to be supplied to the servomotor 2, can be obtained.

Based on the process for pouring the molten metal by the automatic pouring apparatus for tilting a ladle, which process is defined by expressions (11), (12), and (17), FIG. 5 shows a control system having two degrees of freedom, which system, based on the gain-scheduled PI controller, combines the feed-forward control for the rate of the flow of the molten metal by using the inverse model of the model expression for the rate of the flow of the molten metal and the feedback control for the rate of the flow of the molten metal.

In the control system, the feedback part of it estimates the rate of the flow of the molten metal based on the weight of the molten metal poured into the mold that is measured by a load cell by an observer having an exponential damping that uses an extended Kalman filter. Then, the estimated rate of the flow of the molten metal is treated with a gain-scheduled PI controller. Thus, the system for controlling the rate of the flow of the molten metal that can achieve its desired rate with high accuracy can be constituted, when the pouring process is carried out in an environment having existing disturbances.

The feed forward part of the control system has a function wherein the movement of the ladle follows the target value of the rate of the flow of the molten metal. The feedback part of the system has a function to eliminate steady-state errors and existing environmental disturbances.

The model for evaluating the rate of the flow of the molten metal of expressions (11) and (12) has non-linear characteristics regarding the rate of the flow of the molten metal. Thus, to treat a parameter having non-linear characteristics, a gain-scheduled PI controller is used in the feedback controller. The PI controller can vary a proportional gain and an integral gain depending on the rate of the flow of the molten metal.

FIG. 8 shows the results of experiments on the rate of the molten metal of the automatic pouring apparatus. The experiments are applied to the control system having two degrees of freedom for controlling the rate. For the experiments, the ladle is filled with water as a liquid to be handled. For the experiments, any disturbance is defined as an error in the angle of the tilting of the ladle. Namely, the liquid in the ladle actually starts flowing at any position where it is tilted more than +2 degrees beyond the angle of the tilted ladle that is predetermined based on the relationship between the amount of the liquid in the ladle and the angle of the ladle when the liquid starts to flow.

In FIG. 8, the dashed line shows the targeted pattern of the rate of the flow of the molten metal. The continuous line shows the result of an experiment on the rate of the flow of the water of the present invention, which uses the control system having two degrees of freedom. Further, the dashed-dotted line shows the result of an experiment on the rate of the flow of the water, when the feed-forward control system for controlling the rate of the flow of the molten metal is applied to control that of the water.

From these results, for the control system having two degrees of freedom, it was recognized that when the targeted pattern of the rate of the flow of the water was varied, the actual rate of the flow of the water was able to follow the targeted pattern, and that even when the disturbances existed in the pouring process, the actual rate was able to follow the targeted pattern with a high accuracy.

Next, as a second embodiment of the automatic pouring apparatus of the present invention, is explained the automatic pouring apparatus that tilts a ladle that uses a method for compensating for any error of the measurement of the load cell caused by the variation of the center of gravity of the ladle 1 when it is tilted. For the automatic pouring apparatus that tilts a ladle of the first embodiment, which was previously explained, to stabilize the pouring point of the molten metal, the ladle 1 is controlled by moving it backward and forward and upward and downward in coordination with the tilting of the ladle 1 so that the ladle 1 can rotate about the center of its outflow position. Since the upward and downward motions of the ladle 1 cause its center of gravity to vary, an inertial force is generated. Thus, since the inertial force affects the measurements of the weight of the molten metal poured into the mold, which is measured by a load cell, the true weight cannot be obtained.

Therefore, for the second embodiment of the automatic pouring apparatus, since the rate of the flow of the molten metal is estimated based on the weight of the molten metal poured into the mold, which is measured by a load cell, the accuracy of the estimated rate is decreased because of the variation of the center of gravity of the ladle 1.

Thus, to obtain the estimated rate with a high accuracy, a method for compensating for an error of the measurement of the load cell caused by the variation of the center of gravity of the ladle 1 has been conceived.

FIG. 9 shows a block diagram of the method for compensating for an error of the measurement of the load cell. In it $G_{Mv}$ shows a model of a motor for vertically moving the ladle, and $G_{Lv}$ shows a model of a load cell that expresses the relationship between a vertical acceleration of the ladle and the effect caused on the measurement of the load cell.

The model of the load cell used for the method for compensating for an error of the measurement of the load cell is expressed by a second-order lag system as shown by expression (27). Further, the model of the motor for vertically moving the ladle is expressed by a first-order lag system as shown by expression (26), wherein Kmz [mV/s] is the gain of the motor, $T_{mzs}$[s] is the time constant of the motor, $K_l$ [Kgs$^2$/m] is the gain of the load cell, $\omega_{nl}$ [rad/s] is the natural frequency of the load cell, and $\zeta_1$ is a coefficient of damping of the load cell. From the test for identifying the parameters, these are given: $K_{mz}$=0.0828 [mV/s]; $T_{mzs}$=0.007 [s].

$$G_{Mv}(s)=K_{mz}/(1+T_{mzs}) \tag{26}$$

$$G_{Lv}(s)=K_{l\omega nl}/(s^2+2\zeta_{l\omega nl+\omega^2 nl}) \tag{27}$$

Further, the parameters of the model of the load cell are given: $K_l$=0.184; $\omega_{nl}$=0.750; $\zeta_1$=7.44.

Based on the method for compensating for an error of the measurement of the load cell, FIG. 10 shows the result that is obtained by eliminating the influence of the inertial force generated by the vertical acceleration of the ladle 1 from the weight of the molten metal poured into the mold, measured by the load cell.

From the result of experiments, it is understood that the weight of the molten metal poured into the mold that is obtained by a simulation coincides with the weight compensated for by using the method.

Thus, by using the method for compensating for an error of the measurement of the load cell, it is possible to estimate the rate of the flow of the molten metal with high accuracy.

Below, a method for estimating the rate of the flow of the molten metal is explained.

Below, an observer having an exponential damping that uses an extended Kalman filter is explained. The observer having an exponential damping is constructed based on the extended Kalman filter in a discrete-time system. [See this literature: K. Reif; R. Unbehauen; The Extended Kalman Filter as an Exponential Observer for Nonlinear Systems; IEEE, Transactions on Signal Processing; Vol. 47, No. 8, (1999); pp 2324-2328.]

Below, the algorithm of the system is explained. The subject system is shown by expressions (28) and (29), $$z_{n+1}=f(z_n,x_n) \tag{28}$$

$$y_n=h(z_n) \tag{29}$$

wherein $n\epsilon N_0$ is a discrete time, and $z_n\epsilon R_q$, $x_n\epsilon R_q$, $y_n\epsilon R_m$ are state variables, an input, and an output, respectively. Further, it is assumed that functions f and h are function $C^1$. From expressions (28) and (29), the observer is given by expressions (30) and (31), wherein observer gain $K_n$ is a time variable, and expressed by [q×m] matrix.

$$\hat{z}_{n+1}^{-}=f(\hat{z}_n^{+};\chi_n) \tag{30}$$

$$\hat{z}_n^{+}=\hat{z}_n^{-}+K_n(y_n-h(\hat{z}_n^{-})) \tag{31}$$

Further, the estimated state functions:

$$\hat{z}_n^{-},\hat{z}_n^{+}$$

are called an a priori estimate and an a posteriori estimate, respectively.

Next, a gain of the observer $K_n$ is updated by using an algorithm for updating a gain of the Kalman of the extended Kalman filter. The algorithm for updating that gain of the Kalman of the extended Kalman filter is expressed by expressions (32)-(38), wherein Q is a positive definite symmetrical matrix [q×q], R is also a positive definite symmetrical matrix [m×m], and α is a real number of α≧1.

Time Update:

$$\hat{z}_{n+1}^{-} = f(\hat{z}_n^{+}, x_n) \tag{32}$$

$$P_{n+1}^{-} = \alpha^2 A_n P_n^{+} A_n^T + Q \tag{33}$$

-continued

Linearization:

$$A_n = \frac{\partial f}{\partial z}(\hat{z}_n^{+}, x_n) \tag{34}$$

Measurement Update:

$$\hat{z}_n^{+} = \hat{z}_n^{-} + K_n(y_n - h(\hat{z}_n^{-})) \tag{35}$$

$$P_n^{+} = (I - K_n C_n)P_n^{-} \tag{36}$$

Kalman Gain:

$$K_n = P_n^{-} C_n^T (C_n P_n^{-} C_n^T + R)^{-1} \tag{37}$$

Linearization:

$$C_n = \frac{\partial h}{\partial z}(\hat{z}_n^{-}) \tag{38}$$

For the extended Kalman filter, Q and R denote a covariance matrix of the noise of the system and observed noise, respectively. A is a parameter for controlling the degree of convergence. If α=1, it corresponds to the extended Kalman filter.

The observer using the algorithm for updating the gain of the Kalman of the extended Kalman filter explained above corresponds to an observer having an exponential damping. This fact is proven in the following literature. [The literature: K. Reif, R. Unbehauen; The Extended Kalman Filter as an Exponential Observer for Nonlinear Systems; IEEE, Transactions on Signal Processing; Vol. 47, No. 8, (1999), pp 2324-2328]

Next, a system for estimating a rate of flow of molten metal by using the extended Kalman filter for a discrete-time system has been constructed.

First, the system between the angular velocity of tilting the ladle 1 and the weight of molten metal poured into a mold, measured by a load cell, is considered. The differential equations of expressions (11), (12), (16), and (17), which express a pouring system in a continuous-time system, are converted into difference equations. The difference equations that are converted are shown by expressions (39) and (40), wherein $t=nk_s$, $t_s$[s] is a sampling time, and n is a sampling number, namely, n=1, 2, 3, . . .

$$\begin{bmatrix} V_r(n+1) \\ w(n+1) \\ w_l(n+1) \end{bmatrix} = \begin{bmatrix} a_f(V_r(n))t_s + b_f(n)t_s\omega(n) + V_r(n) \\ a_f(V_r(n))t_s + \omega(n) \\ e^{-\frac{t_s}{T_l}} w_l(n) + \left(1 - e^{\frac{t_s}{T_l}}\right)w(n) \end{bmatrix} \tag{39}$$

$$y(n) = w_l(n) \tag{40}$$

wherein $a_f$ and $b_f$ are shown by expressions (41) and (42).

$$a_f(V_r(n)) = -c\int_0^{\frac{V_r(n)}{A(\theta(n))}} \left(L_f(h_b)\sqrt{2gh_b}\right)dh_b \tag{41}$$

$$b_f(n) = -\frac{\partial V_s(\theta(n))}{\partial \theta(n)} \tag{42}$$

The observer having an exponential damping is constructed based on expressions (39) and (40).

Expressions (39) and (40) can also be expressed as expressions (43) (46) by using expressions (30) and (31).

$$z_n = [V_r(n)w(n)w_l(n)]^T \tag{43}$$

$$x(n) = \omega(n) \tag{44}$$

$$f(z_n, x_n) = \begin{bmatrix} a_f(V_r(n))t_s + b_f(n)t_s x(n) + V_r(n) \\ a_f(V_r(n))t_s + w(n) \\ e^{-\frac{t_s}{T_l}} w_l(n) + \left(1 - e^{\frac{t_s}{T_l}}\right) w(n) \end{bmatrix} \tag{45}$$

$$h(z_n) = w_l(n) \tag{46}$$

$$\begin{bmatrix} V_r(n+1) \\ w(n+1) \\ w_l(n+1) \end{bmatrix} = \begin{bmatrix} a_f(V_r(n))t_s + b_f(n)t_s\omega(n) + V_r(n) \\ a_f(V_r(n))t_s + \omega(n) \\ e^{-\frac{t_s}{T_l}} w_l(n) + \left(1 - e^{\frac{t_s}{T_l}}\right) w(n) \end{bmatrix} + \begin{bmatrix} v_q(n) \\ v_w(n) \\ v_{wl}(n) \end{bmatrix} \tag{47}$$

Namely, a mismatch between the desired angle of the ladle 1 when the molten metal starts to flow from it and the actual angle is caused. Thus, to simulate the mismatch between the desired angle and the actual angle, experiments for estimating the rate of the flow of the molten metal were carried out.

Next, a dispersion of v is obtained by comparing the results of experiments with $w_1$, which is obtained by a simulation using expression (47). It aims to estimate the rate of the flow of the molten metal even if there is mismatch of 3 [degrees] between the desired angle of the ladle 1 when the molten metal starts to flow from the ladle 1 and the actual one. For that purpose, by handling the initial mismatch of the angle of 3 [degrees] as noise of the system, the system for estimating the rate of the flow of the molten metal that takes account the initial mismatch of the angle is constructed. FIG. 10 shows the results of the experiments with the initial mismatch of the angle of 3 [degrees] and shows $w_l$, which is obtained by the expression (47), which takes account of the noise of the system. The dispersion of each part of the noise of the system is set as follows, so that the rate of the flow of the molten metal approaches the results of the experiments with the initial mismatch of the angle of 3 [degrees]: $\Sigma v_q = 1.0\times10^{-10}[m^6/s^2]$, $\Sigma v_w = 1.0\times10^{-12}[m^6]$, $\Sigma v_{wl} = 1.0\times10^{-12}[m^6]$.

From FIG. 11, by taking account in the simulation the noise of the system, it is understood that the weight of molten metal poured into a mold that is obtained by the simulation approaches the results of the experiments with the initial mismatch of the angle of 3 [degrees].

Based on the result explained in the above paragraphs, a covariance matrix Q is shown by expression (48).

$$Q = \begin{bmatrix} \sum_{v_q} & 0 & 0 \\ 0 & \sum_{v_w} & 0 \\ 0 & 0 & \sum_{v_{w_l}} \end{bmatrix} \tag{48}$$

Next, the rate of the flow of the molten metal is estimated by an observer having an exponential damping that uses an extended Kalman filter in a discrete-time system that is constructed as in the above paragraphs. FIG. 12 shows the results of the simulation for estimating the rate of the flow of the molten metal and the result of the experiments. The gain of the observer is shown in FIG. 13, wherein the gain is defined as $K_n = [K_g\ K_w\ K_{wl}]^T$.

From the result of the simulation for estimating the rate of the flow of the molten metal and the result of the experiments, it is understood that the rate of the flow of the molten metal can be estimated with high accuracy.

In a casting plant, when molten metal is supplied to the ladle 1, the operation is manually carried out. Thus, it is difficult for a predetermined amount of the molten metal to be supplied to the ladle with high accuracy. Thus, the angle at which the ladle tilts when the molten metal starts to flow from the ladle 1 varies greatly.

If the weight of the content of the ladle 1 and the shape of the ladle 1 are known, the data on the angle at which the ladle tilts when the molten metal starts to flow from the ladle 1 can be obtained by a calculation. However, since the inner shape of the ladle 1 is manually formed, an accurate shape cannot be obtained. Thus, it is difficult to obtain an accurate angle for the tilt of the ladle when the molten metal starts to flow from the ladle 1. Namely, a mismatch between the desired angle of the ladle 1 when the molten metal starts to flow from the ladle 1 and the actual angle is caused. Thus, to simulate the mismatch between the desired angle and the actual angle, experiments for estimating the rate of the flow of the molten metal were carried out.

FIG. 14 shows the result of the experiments for estimating the rate of the flow of the molten metal when there is a mismatch of angle of 1, 3, and 5 [degrees], wherein the initial angle of the tilt is 26 [degrees]. As shown in FIG. 14, when the mismatch of the angle is greater than 3 [degrees], the error of the estimated rate of the flow of the molten metal at the initial stage become greater. However, it is found that the rate can be estimated at the following stage with high accuracy.

In the actual casting plant, since the mismatch between the calculated angle of the ladle 1 when the molten metal starts to flow from the ladle 1 and actual angle is about 2 [degrees], it is found that the rate of the flow of the molten metal can be estimated with high accuracy.

For the observer that uses the extended Kalman filter, the gain of the observer Kn can be systematically obtained only by using the noise of the system and the observed noise. Further, by controlling the covariance matrix of the noise of the system, when a certain level of disturbance is generated, desired state functions can be estimated.

For the second embodiment of the automatic pouring apparatus of this invention, the method for compensating for an error of the measurement of the load cell is used to eliminate the effects caused by the variation of the center of gravity of the ladle 1 when it is tilted. The load cell may be installed wherever the static weight of the ladle containing the molten metal and the inertial force generated by the acceleration caused by moving the ladle upward and downward can be measured at the same time. For example, the load cell may be installed on the moving member that supports the ladle 1, and that can move backward and forward and upward and downward together with the ladle 1.

BRIEF DESCRIPTIONS OF THE DRAWINGS

Figure 1:
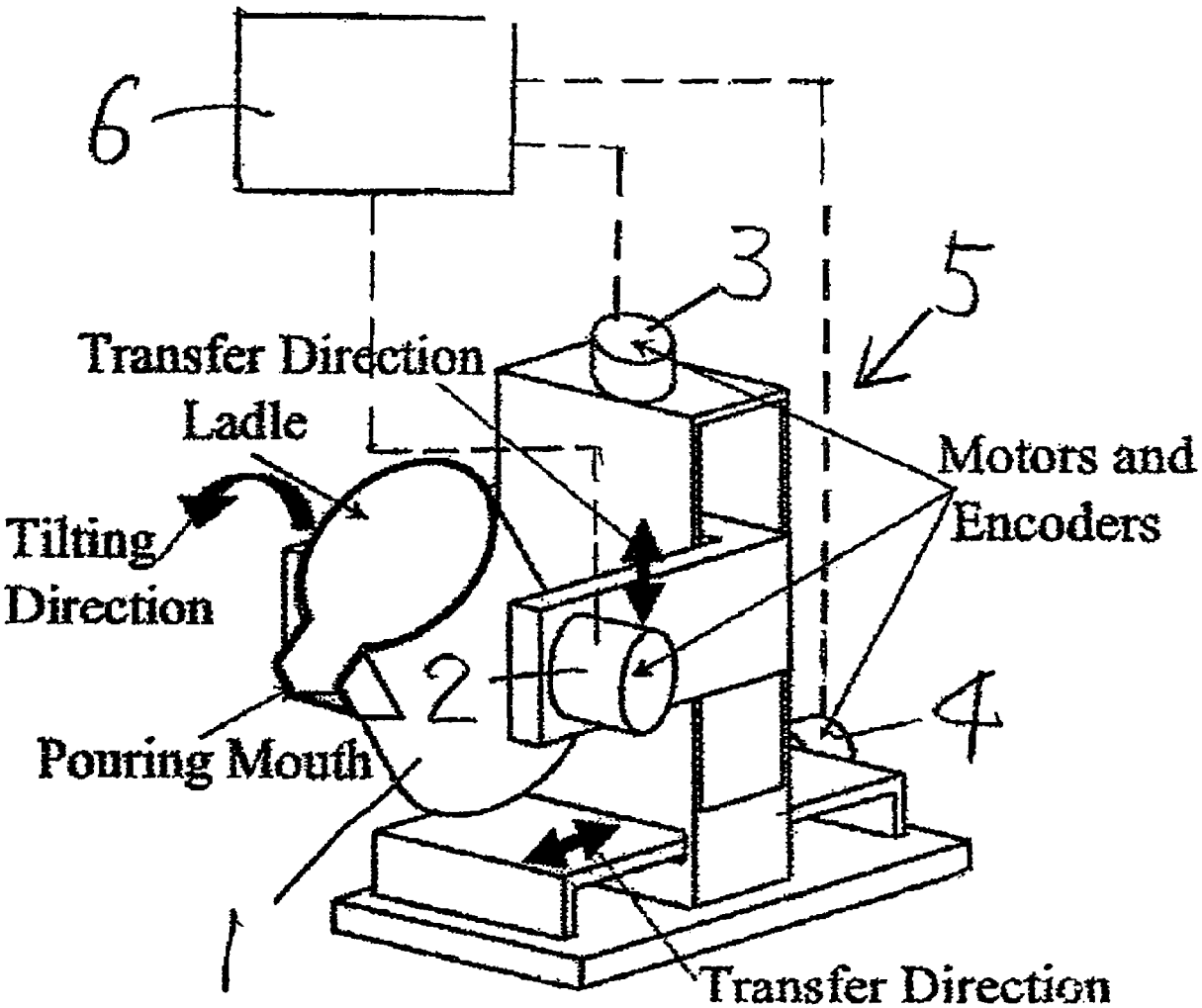
FIG. 1 shows an external view of one embodiment of the automatic pouring apparatus to which the method of the present invention is applied.
Figure 2:
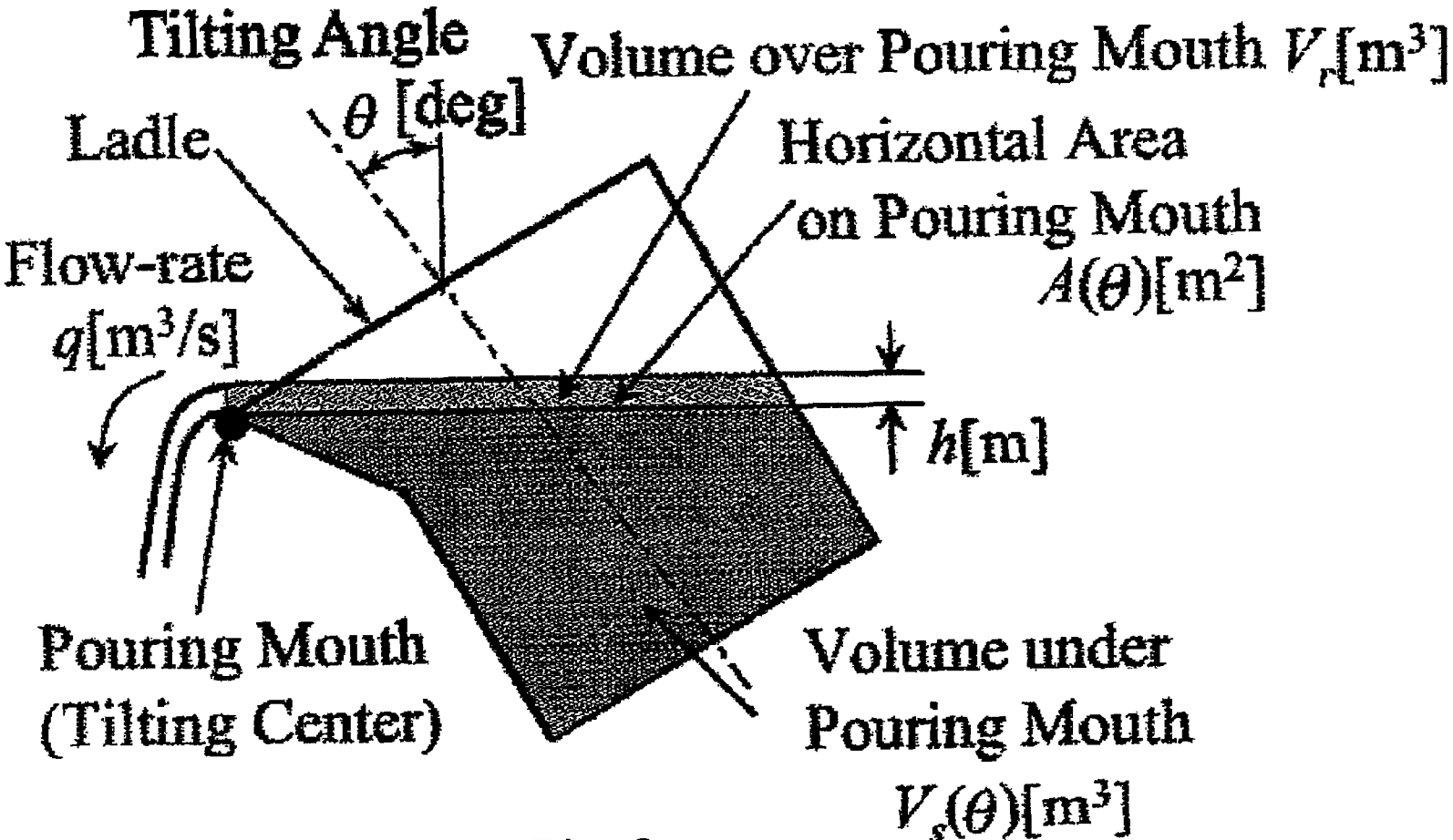
FIG. 2 is a vertical cross-sectional view of the ladle of the automatic pouring apparatus of FIG. 1.
Figure 3:
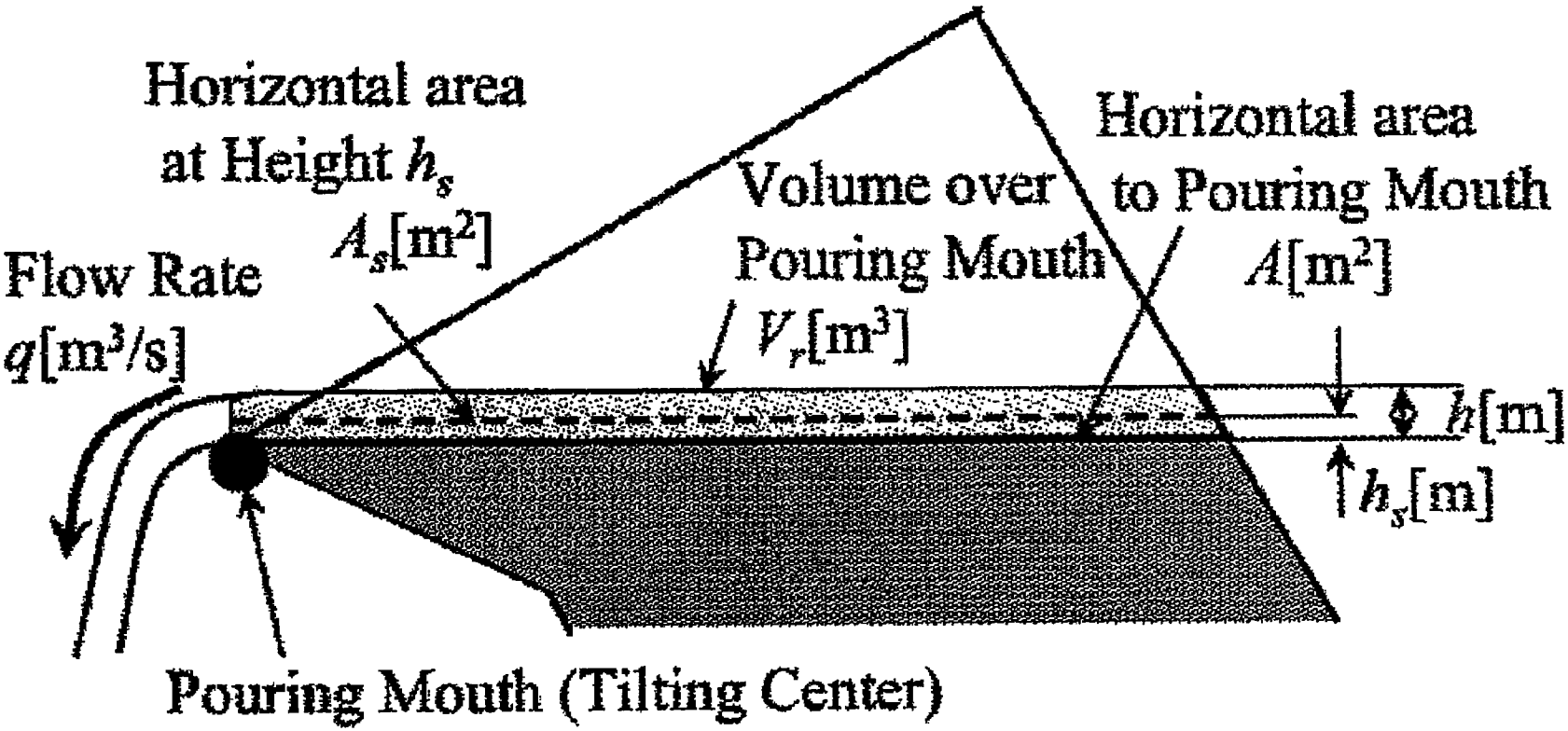
FIG. 3 is an enlarged view of the main part of FIG. 2.
Figure 4:
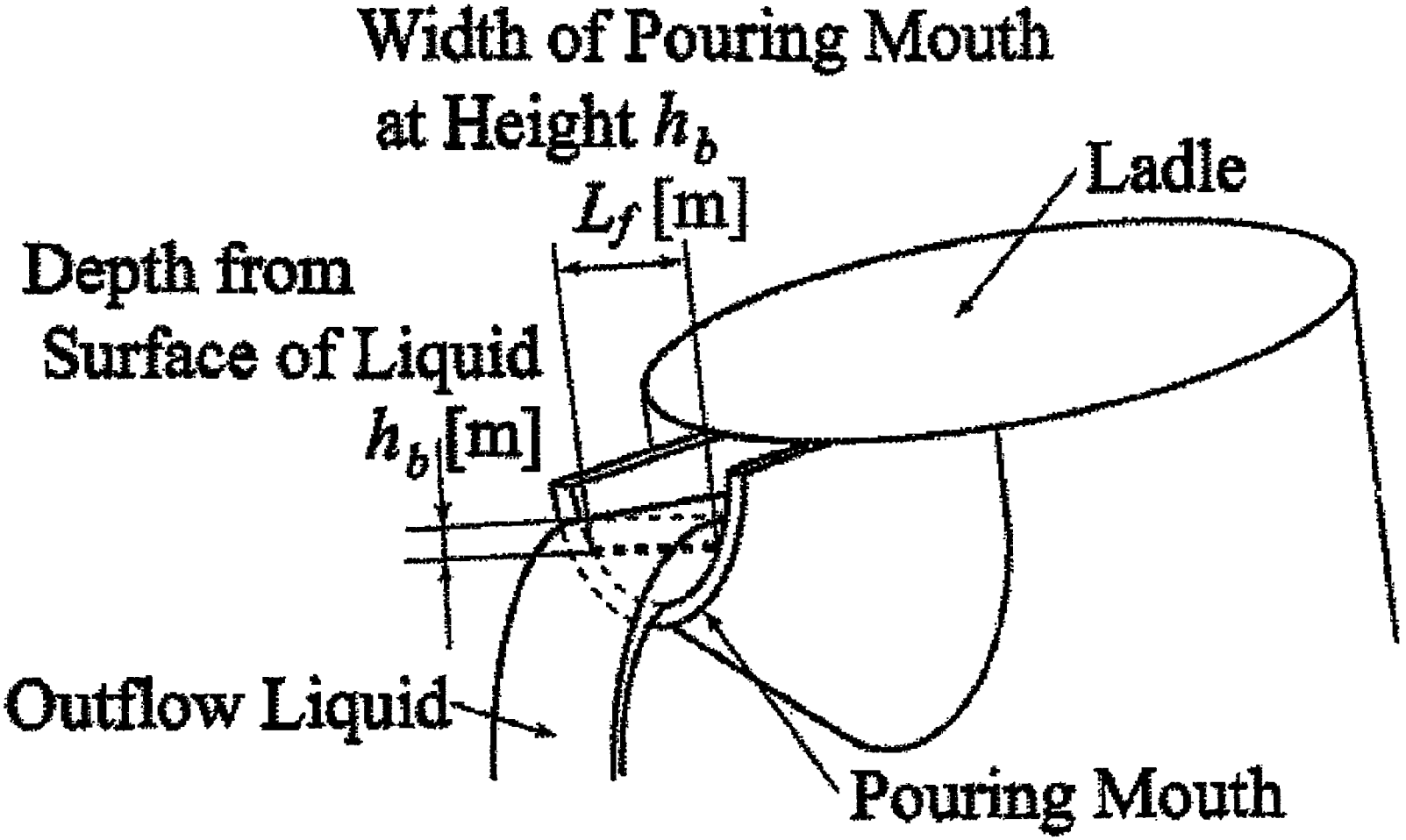
FIG. 4 is a perspective view of the end of the outflow position of the ladle.
Figure 5:
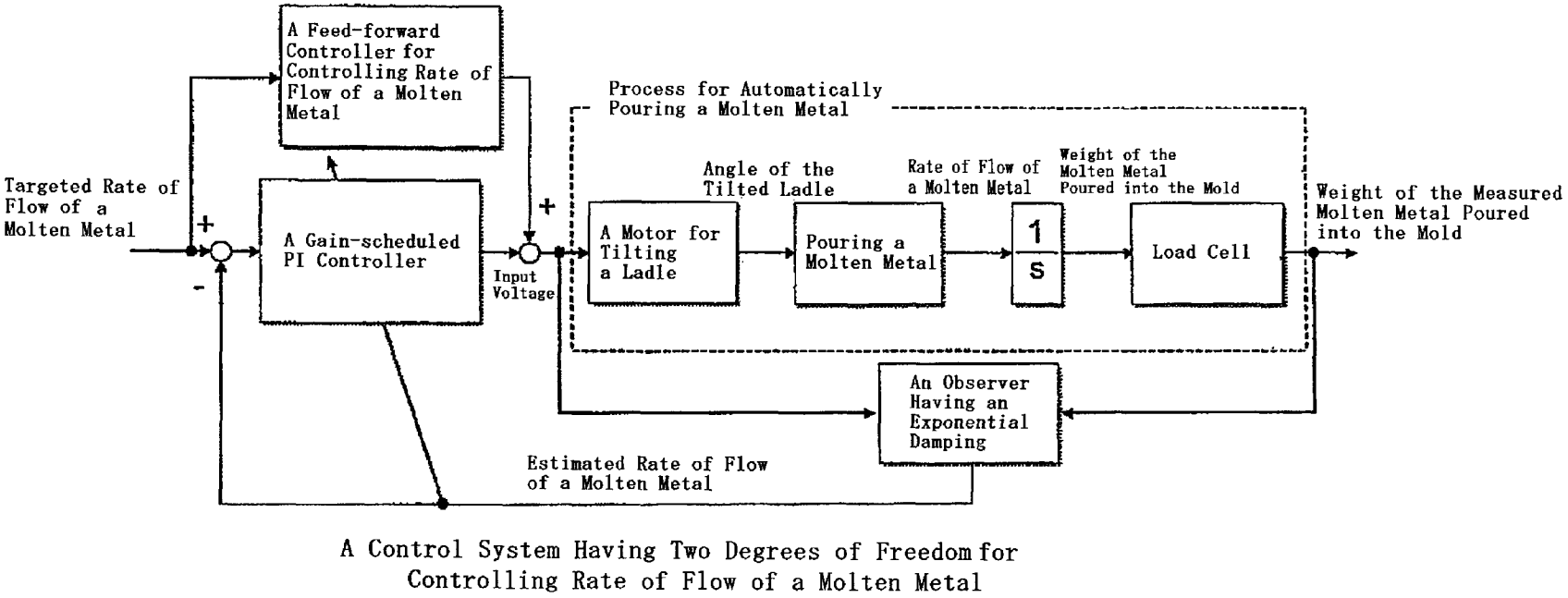
FIG. 5 is a block diagram showing a process of pouring in the automatic pouring apparatus of a first embodiment.
Figure 6:
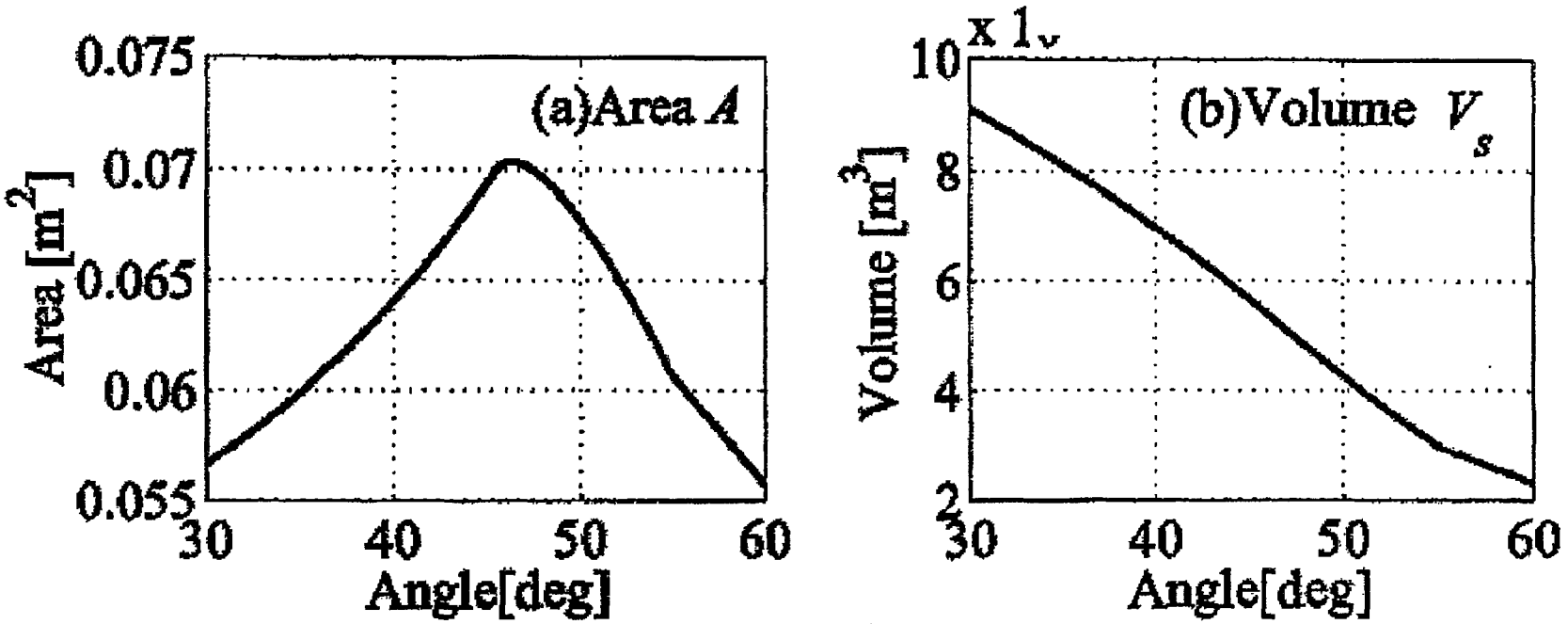
FIG. 6 shows graphs of the relationship of the horizontal area on the outflow position, A (θ)[$m^2$], to the angle of the tilting of the ladle 1, θ [degrees], and the volume of the molten metal below the outflow position, Vs (θ) [$m^3$], to the angle of the tilting of the ladle 1, θ [degrees].
Figure 7:
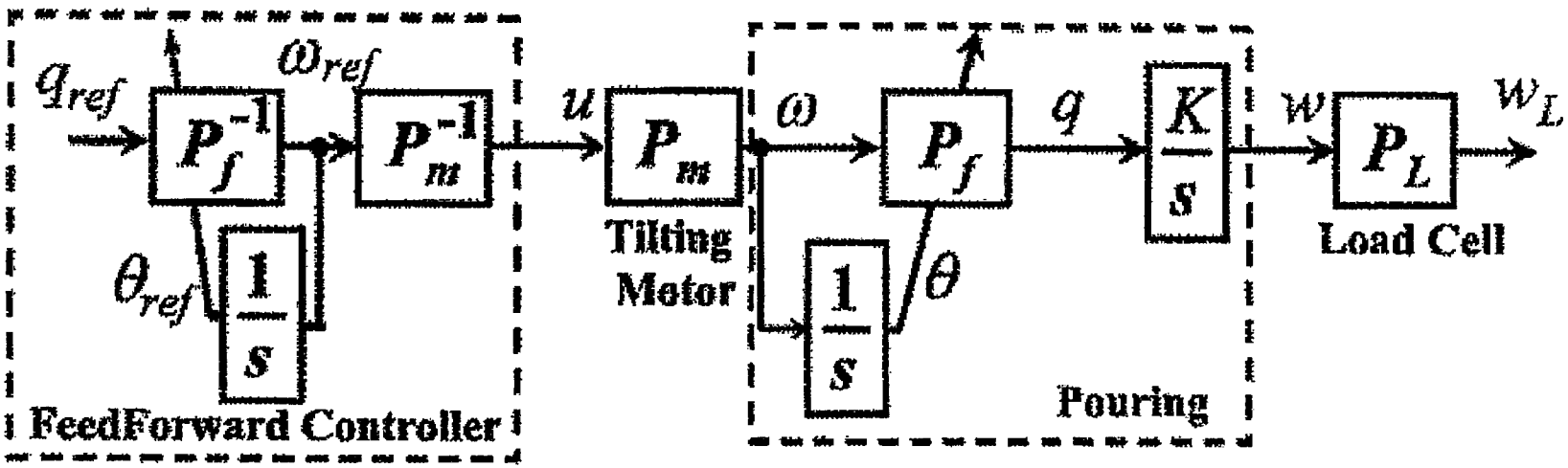
FIG. 7 is a block diagram of a feed-forward control system to control the rate of the flow of the molten metal.
Figure 8:
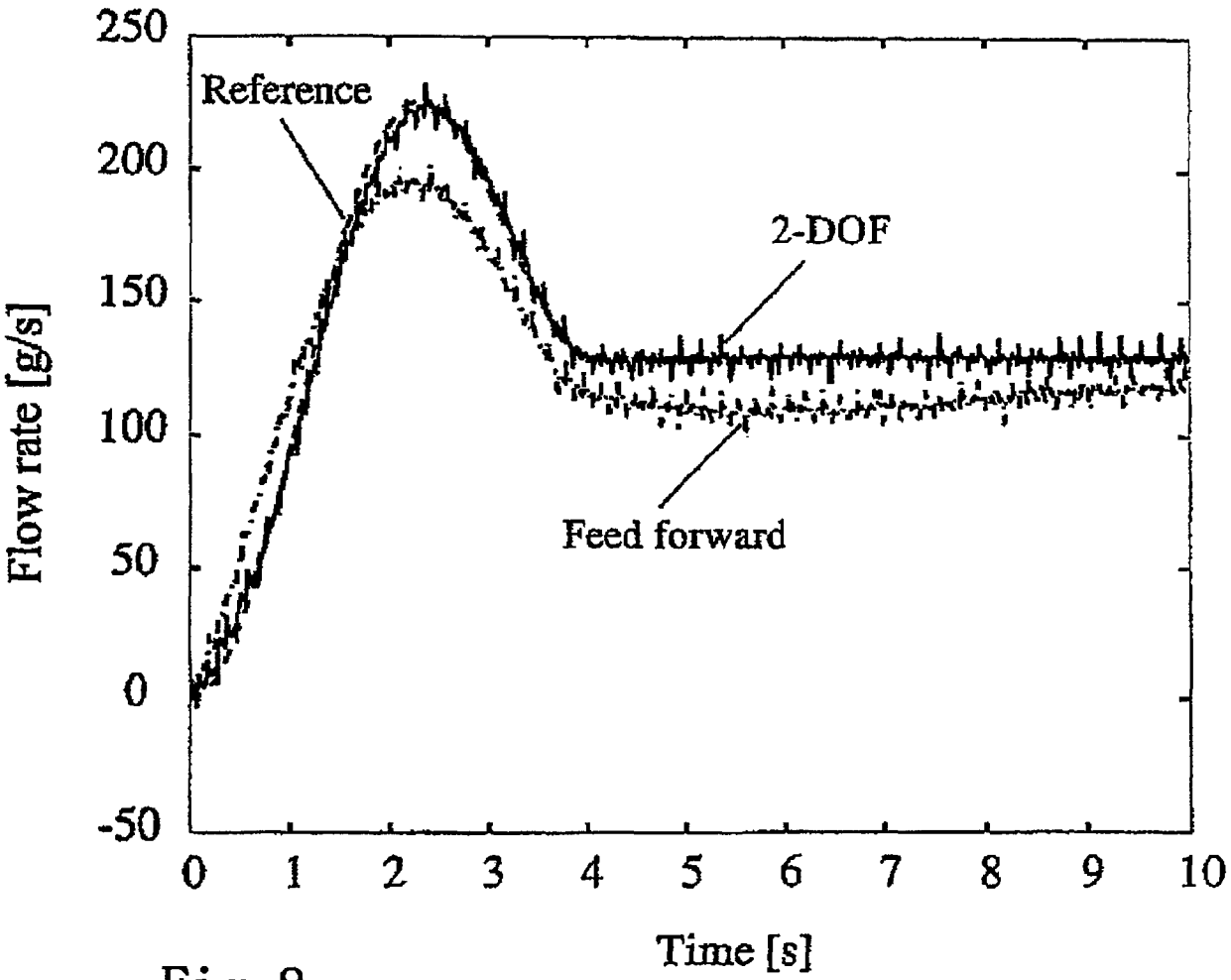
FIG. 8 shows the results of the experiments on the rate of the molten metal of the automatic pouring apparatus that is applied to the control system having two degrees of freedom for controlling the rate, and that is filled with water as a liquid to be handled.
Figure 9:
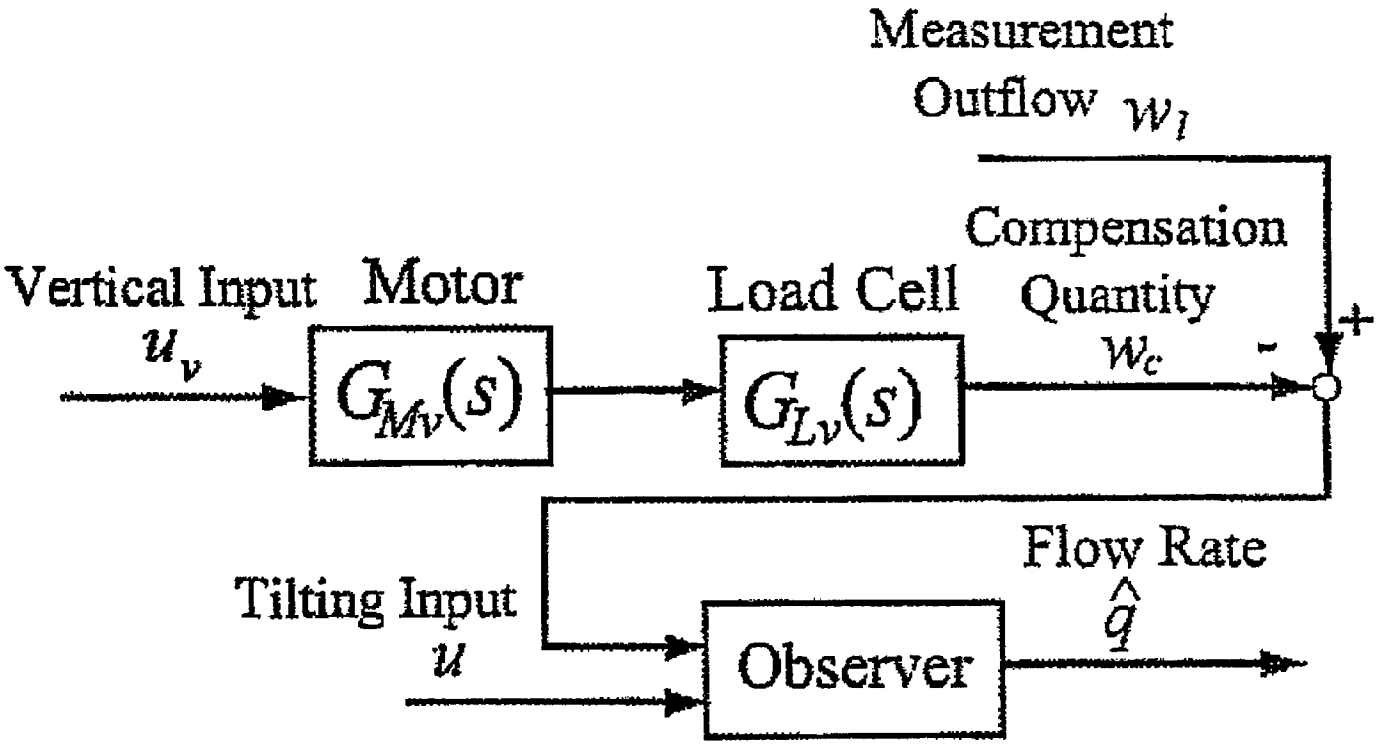
FIG. 9 is a block diagram of the method for compensating for an error of the measurement of the load cell.
Figure 10:
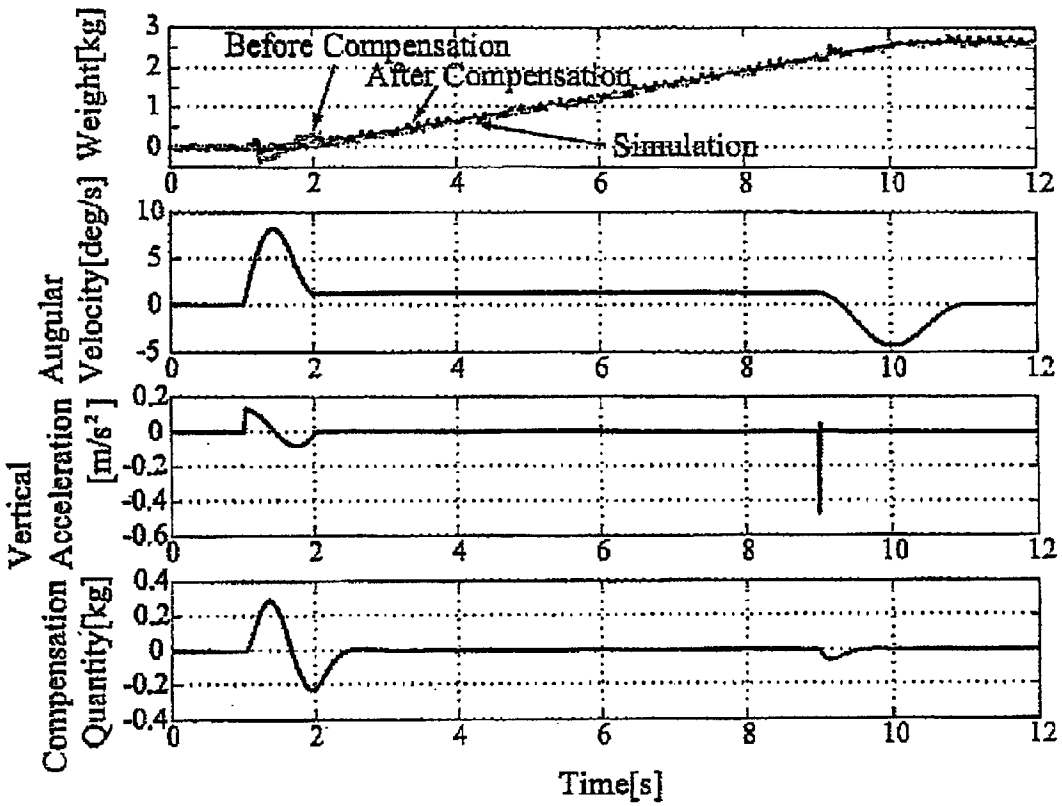
FIG. 10 shows the result that is obtained by eliminating an error of the measurement of the load cell from the weight of the molten metal poured into the mold, measured by the load cell.
Figure 11:
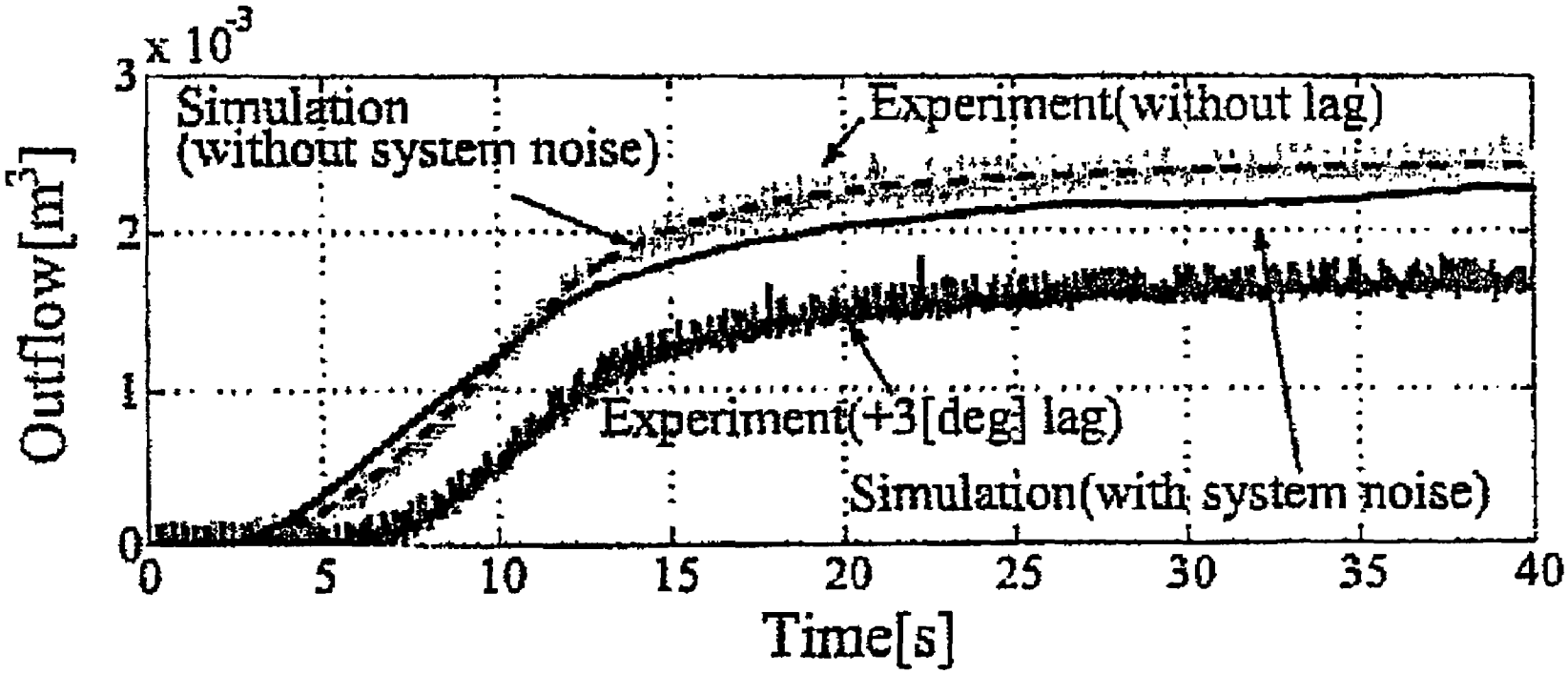
FIG. 11 is a graph that shows the result of the simulation for pouring the molten metal when there is the noise in the system.
Figure 12:
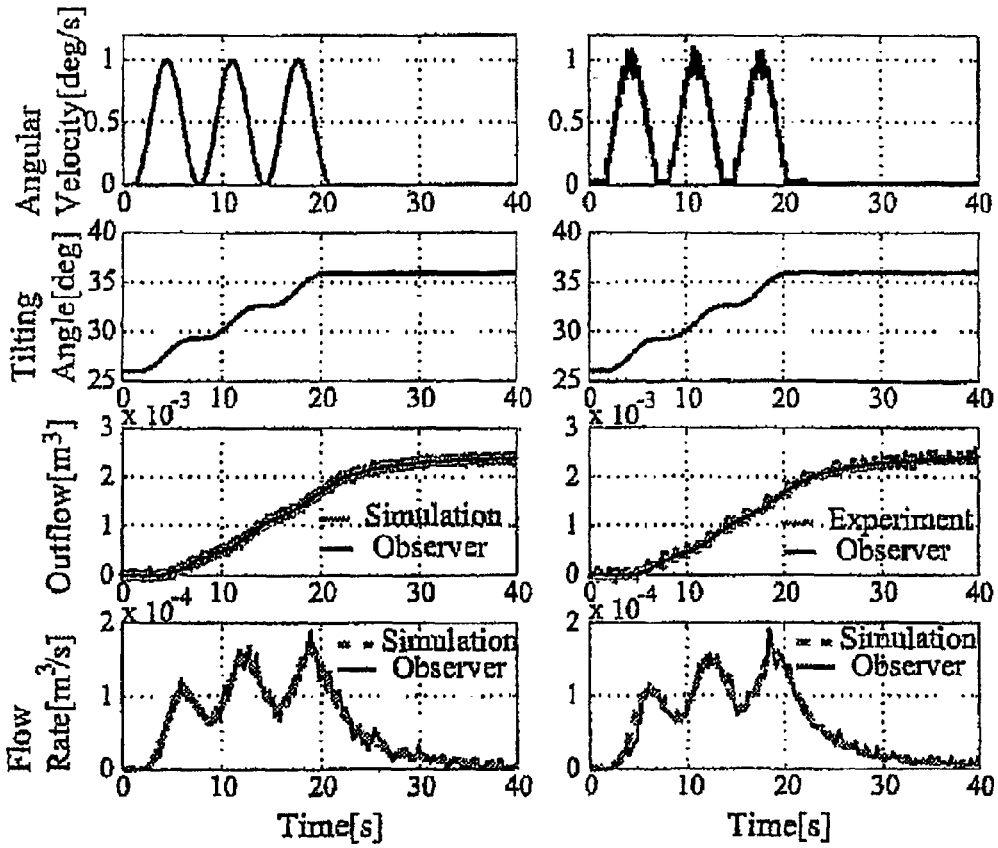
FIG. 12 shows the results of the simulation for estimating the rate of the flow of the molten metal by means of the observer having an exponential damping that uses the extended Kalman filter in a discrete-time system and the results of the experiments.
Figure 13:
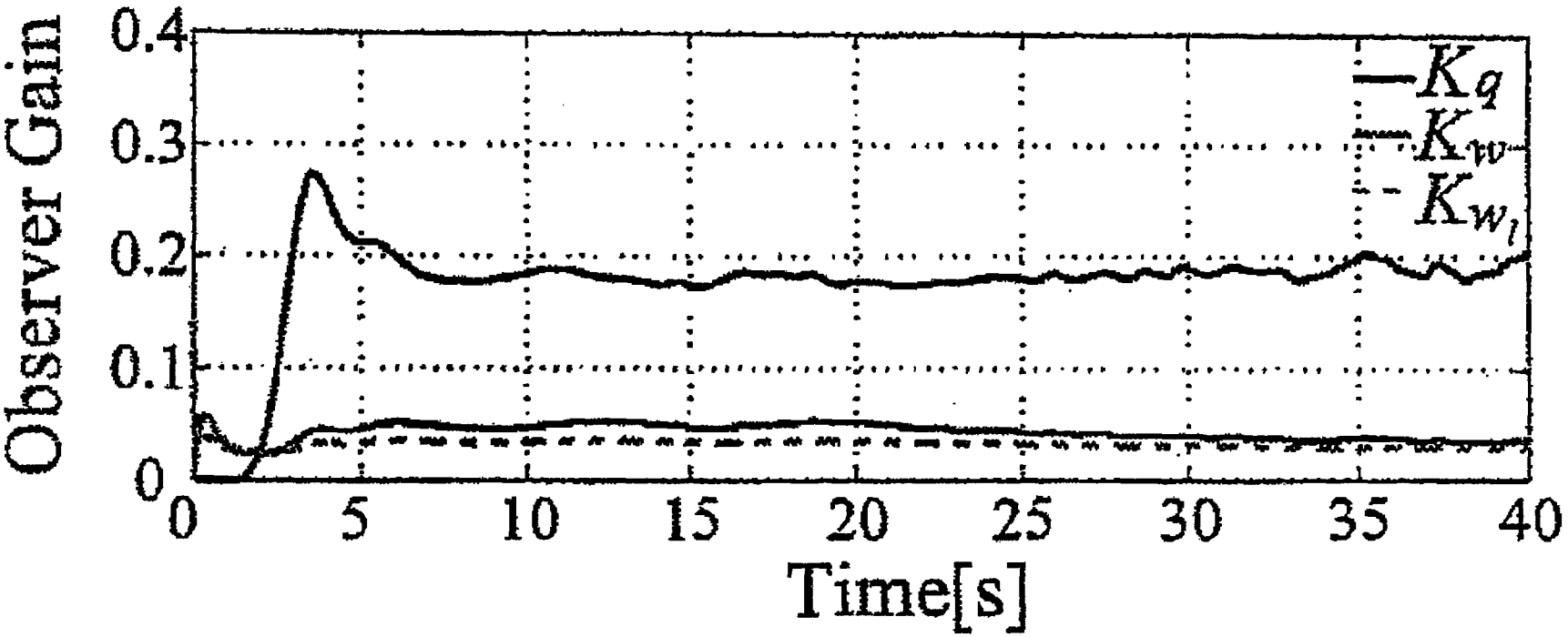
FIG. 13 is a graph that shows the gain of the observer of FIG. 12.
Figure 14:
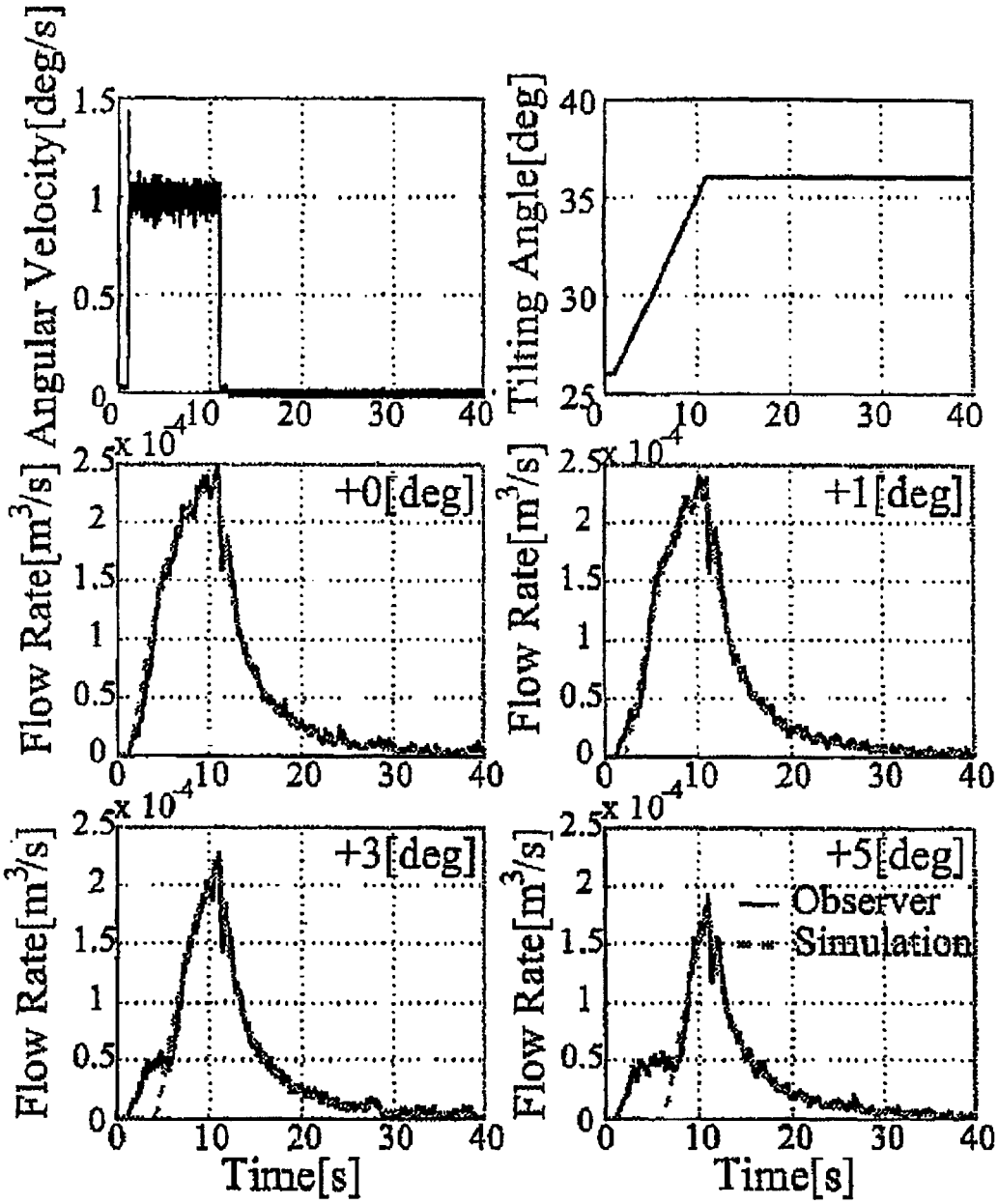
FIG. 14 shows graphs that show the result of the experiments for estimating the rate of the flow of the molten metal when the initial mismatch of the angles of the tilted ladle is caused.

The invention claimed is:

1. A method for controlling a ladle to pour molten metal into a mold, the method comprising:

supplying a mathematical model describing an electrical voltage supplied to a servomotor for tilting the ladle as a function of a flow rate of the molten metal flowing out of the ladle when the ladle is tilted;

measuring an actual electrical voltage supplied to the servomotor;

solving an inverse problem of the mathematical model using the measured voltage;

estimating the flow rate of the molten metal using a state observer having an exponential damping that uses an extended Kalman filter, based on the measured voltage and a weight of the molten metal poured into the mold, the weight being measured by a weighing equipment and calibrated by eliminating errors caused by a movement of a center of gravity of the ladle;

processing the flow rate of the molten metal and a target flow rate of the molten metal with a gain-scheduled PI controller;

obtaining a target electrical voltage to be supplied to the servomotor; and controlling the servomotor based on the target electrical voltage.

2. The method of claim 1, further comprising:

processing, after processing the flow rate of the molten metal and the target flow rate of the molten metal with the PI controller, the target flow rate of the molten metal with a feed-forward controller, wherein obtaining the target electrical voltage includes obtaining the target electrical voltage by adding a processing result obtained by the PI controller to a processing result obtained by the feed-forward controller.

3. The method of claim 1 or 2, wherein the errors caused by the movement of the center of gravity of the ladle comprise errors caused by an inertial force generated by a vertical acceleration of the ladle while the ladle is tilting.

4. The method of claim 1 or 2, wherein estimating the flow rate of the molten metal using the observer includes estimating using the observer, at real time, a weight of the molten metal poured from the ladle per unit time, based on the measured electrical voltage and the weight of the molten metal poured into the mold.

5. The method of claim 1 or 2, wherein the ladle has one of a cylindrical shape or fan shape.

6. A system for controlling a ladle to pour molten metal into a mold, the system comprising:

a servomotor for tilting the ladle; and a control system for controlling the servomotor, the control system comprising:

a model-supplying device storing a mathematical model describing an electrical voltage supplied to the servomotor as a function of a flow rate of the molten metal flowing out of the ladle when the ladle is tilted;

a measuring device measuring an actual electrical voltage supplied to the servomotor;

a computing device solving an inverse problem of the mathematical model using the measured voltage;

an estimating device estimating the flow rate of the molten metal using a state observer having an exponential damping that uses an extended Kalman filter, based on the measured voltage and a weight of the molten metal poured into the mold, the weight being measured by a weighing equipment and calibrated by eliminating errors caused by a movement of a center of gravity of the ladle; and a processing device processing the flow rate of the molten metal and a target flow rate of the molten metal with a gain-scheduled PI controller.

7. A computer-readable non-transitory storage medium storing computer instructions which, when executed by a computer:

supply a mathematical model describing an electrical voltage supplied to a servomotor for tilting the ladle and a flow rate of the molten metal flowing out of the ladle when the ladle is titled;

measure an actual electrical voltage supplied to the servomotor;

solve an inverse problem of the mathematical model using the measured voltage;

estimate the flow rate of the molten metal using a state observer having an exponential damping that uses an extended Kalman filter, based on the measured voltage and a weight of the molten metal poured into the mold, the weight being measured by a weighing equipment and calibrated by eliminating errors caused by a movement of a center of gravity of the ladle;

process the flow rate of the molten metal and a target flow rate of the molten metal with a gain-scheduled PI controller;

obtain a target electrical voltage to be supplied to the servomotor; and control the servomotor based on the target electrical voltage.

8. The storage medium of claim 7, storing additional computer instructions which, when executed by the computer:

process, after processing the flow rate of the molten metal and the target flow rate of the molten metal with the PI controller, the target flow rate of the molten metal with a feed-forward controller, wherein controlling the computer to obtain the target electrical voltage includes controlling the computer to obtain the target electrical voltage by adding a processing result obtained by the PI controller to a processing result obtained by the feed-forward controller.

* * * * *

UNITED STATES PATENT AND TRADEMARK OFFICE

CERTIFICATE OF CORRECTION

PATENT NO. : 8,202,472 B2
APPLICATION NO. : 12/597143
DATED : June 19, 2012
INVENTOR(S) : Yoshiyuki Noda et al.

It is certified that error appears in the above-identified patent and that said Letters Patent is hereby corrected as shown below:

Claim 5, Column 14, Line 5, "or fan shape" should read -- or a fan shape --.

Signed and Sealed this
Twelfth Day of March, 2013

Teresa Stanek Rea
*Acting Director of the United States Patent and Trademark Office*